US005309710A

United States Patent [19]

Corr, II

[11] Patent Number: 5,309,710

[45] Date of Patent: May 10, 1994

[54] GAS TURBINE COMBUSTOR HAVING POPPET VALVES FOR AIR DISTRIBUTION CONTROL

[75] Inventor: Robert A. Corr, II, Scotia, N.Y.

[73] Assignee: General Electric Company, Schenectady, N.Y.

[21] Appl. No.: 979,657

[22] Filed: Nov. 20, 1992

[51] Int. Cl.[5] ..... F02C 9/16

[52] U.S. Cl. ..... 60/39.23; 60/39.29

[58] Field of Search ..... 60/39.23, 39.29, 39.37, 60/760

[56] References Cited

U.S. PATENT DOCUMENTS

| | | | |
|---|---|---|---|
| 3,280,555 | 10/1966 | Charpentier et al. | 60/39.23 |
| 3,691,761 | 9/1972 | Jackson et al. | 60/39.23 |
| 3,919,838 | 11/1975 | Armstrong . | |
| 3,958,416 | 5/1976 | Hammond, Jr. . | |
| 4,050,238 | 9/1977 | Holzapfel | 60/39.23 |
| 4,054,028 | 10/1977 | Kawaguchi | 60/39.23 |
| 4,149,371 | 4/1979 | Spraker et al. . | |
| 4,171,612 | 10/1979 | Zwick | 60/39.29 |
| 4,255,927 | 3/1981 | Johnson et al. | 60/39.29 |
| 4,292,801 | 10/1981 | Wilkes et al. . | |
| 4,297,842 | 11/1981 | Gerhold et al. . | |
| 4,337,616 | 7/1982 | Downing . | |
| 4,766,721 | 8/1988 | Iizuka et al. . | |
| 4,928,481 | 5/1990 | Joshi et al. . | |
| 4,944,149 | 7/1990 | Kuwata . | |
| 4,982,570 | 1/1991 | Waslo . | |
| 4,984,429 | 1/1991 | Waslo et al. . | |
| 5,000,004 | 3/1991 | Yamanaka et al. . | |
| 5,117,636 | 6/1992 | Bechtel, II et al. . | |
| 5,121,597 | 6/1992 | Urushidani et al. . | |
| 5,125,227 | 6/1992 | Ford et al. . | |
| 5,127,221 | 7/1992 | Beebe . | |
| 5,139,755 | 8/1992 | Seeker et al. . | |

FOREIGN PATENT DOCUMENTS 265602 6/1927 Fed. Rep. of Germany ..... 60/39.23

OTHER PUBLICATIONS

"Development of a Natural Gas-Fired, Ultra-Low NOx Can Combustor for an 800 KW Gas Turbine," Smith et al, The Am. Soc. of Mech. Eng. 91-GT-303, pp. 1-7, Jun. 1991.

*Primary Examiner*—Richard A. Bertsch
*Assistant Examiner*—Timothy S. Thorpe
*Attorney, Agent, or Firm*—Nixon & Vanderhye

[57] ABSTRACT

A poppet valve system for controlling the air distribution within the combustor of a gas turbine. The cylindrical combustor includes a concentric combustion lining where air and fuel are mixed and burned near a flame holder, and a dilution air manifold that injects dilution air into the combustion lining downstream of the flame holder. Air enters the dilution air manifold and the liner mixing zone through openings that can be closed by poppet valves. Each poppet valve is operated to close either an opening in the combustion liner to the mixing zone or a corresponding opening in the dilution air manifold. The volume of air mixing with fuel in the mixing zone is controlled by operation of the poppet valves.

7 Claims, 4 Drawing Sheets

GAS TURBINE COMBUSTOR HAVING POPPET VALVES FOR AIR DISTRIBUTION CONTROL

TECHNICAL FIELD

This invention relates to air distribution controls for combustors and, particularly, to combustors for gas turbines.

BACKGROUND ART

Gas turbines generally include a compressor, one or more combustors, a fuel injection system and a turbine. Pressurized air flows from the compressor into the combustor where the air is mixed with fuel and the gaseous mixture burns. Typically, air from the compressor is turned through ducts in the combustor back towards an annular array of cylindrical combustors. Some of the air entering the combustor is mixed with fuel in mixing zones at the upstream end of the combustor. Some air flows around the combustor to cool the lining of the combustor and some air flows into dilution zones in the combustor. The heated air and combustion gases exit the combustor through transition ducts and enter the inlet to the turbines.

Combustors used in industrial gas turbines are often required to have reduced emissions of nitrogen oxide (NOx) pollutants. The amount of NOx emissions is directly related to the combustion temperature in the gas turbine. Most efforts to reduce NOx emissions have focused on reducing combustion temperature. For example, lean, premixed combustors reduce the fuel/air ratio to less than the stoichiometric ratio. This lean fuel/air ratio reduces the peak flame temperature to much less than in an unabated diffusion flame. NOx emissions are minimized by maintaining a low flame temperature.

If the fuel/air ratio becomes excessively lean, the flame will extinguish. However, NOx emissions increase dramatically if the fuel/air ratio becomes less lean, i.e., the ratio increases. It is desirable to maintain the fuel/air ratio constant and slightly above that required to maintain combustion to minimize NOx emissions.

Lean fuel/air ratios are typically used in lean, premixed combustors, but these combustors are particularly sensitive to variations in airflow. For example, a decrease of 5% (or less) in the airflow may cause a too rich fuel/air ratio and excessive NOx emissions. Similarly, an increase of 5% (or less) in airflow may cause the fuel/air ratio to become too lean and extinguish the flame. Previous lean, premixed combustors were unable to fully modulate the airflow into the mixing zone(s) so as to maintain a constant fuel/air ratio. Accordingly, maintaining a constant fuel/air ratio has been a continuing problem for low NOx combustors.

Maintaining a constant fuel/air ratio is critical to low NOx emissions, but is difficult to accomplish. The fuel flow rate into the combustor varies by a factor of four or more over the load range of an industrial gas turbine. To hold the fuel/air ratio constant, the airflow rate must vary in tandem with the fuel flow rate. In addition, the airflow to an individual combustor and its combusting zone is sensitive to manufacturing tolerances, machine mechanical conditions, ambient temperature and component changes in the gas turbine. These factors complicate the control of airflow to an individual combustor needed to maintain a constant fuel/air ratio. Airflow control becomes more complicated when several combustors are used together, as is common in industrial gas turbines.

There are several different techniques that have been used to allow lean, premixed combustors to operate over the entire load range in industrial gas turbines. One example is fuel staging which is shown in FIGS. 1A to 1D. With fuel staging in the combustor 1, the combustion liner 2 is divided into an upstream primary zone 3 and a downstream flame holding zone 4. In the embodiment shown here flame holding is accomplished with a venturi 5, but there are other ways to achieve flame holding. To ignite the combustor (and for operation up to about 20% load of the gas turbine) fuel is injected into the combustor through nozzles 6 at the upstream end of the primary zone 3, as is shown in FIG. 1A. During this start-up phase, the fuel/air ratio is near the stoichiometric ratio and the fuel/air mixture combusts in the primary zone to produce a diffusion flame.

As shown in FIG. 1B, when the load on the gas turbine increases, about 30% of the fuel is introduced through a central nozzle 7 into the venturi flame holder and downstream of the primary zone 3 where the air and fuel from nozzles 6 mix. The amount of fuel injected through the central nozzle into the flame holder is gradually increased, while the amount of fuel injected into the primary zone is gradually reduced to starve the flame in the primary zone. As shown in FIG. 1C, to extinguish the flame in the primary zone, no fuel enters the primary zone through nozzles 6 and all of the fuel is directly injected into the flame holder zone. As shown in FIG. 1D, after the flame in the primary zone is extinguished, fuel is again injected into the primary zone for mixing with air, but the fuel/air mixture does not combust until reaching the venturi flame holder zone 4. A small portion of fuel, about 17%, flows through nozzle 50 to maintain a rich fuel/air mixture at the flame kernel at the start of the flame in the flame holder zone.

While there are variations on fuel staging, all suffer the disadvantage that they cannot compensate for variations in the airflow to the combustor. Fluctuations in the airflow cause undesirable variations in the fuel/air ratios.

To control the volume of air entering the combustor mixing (primary) zone, it is known to use inlet guide vanes in front of one or more stages of the compressor. Inlet guide vanes reduce the mass of air through the gas turbine. However, inlet guide vanes hamper the capacity of scavenging systems that recover heat for steam production. In addition, inlet guide vanes cannot increase the airflow to the combustor once they are fully open as is common during normal operating conditions. When a gas turbine is operating at full load, the fully open inlet guide vanes are limited to increasing (not decreasing) the fuel/air ratio.

Similarly, air staging schemes have been used to reduce the open area to the dilution plane in a combustor so as to reduce the airflow into the secondary burning area of a combustor. U.S. Pat. No. 4,944,149 discloses an example of air staging. Air staging at the combustor dilution plane suffers the disadvantages of increasing the pressure drop through the combustor by closing openings in the combustors. This pressure drop reduces gas turbine efficiency, especially when the gas turbine is at full load with maximum fuel flow when the diffusion openings are closed.

In addition, air staging has been applied to the open area of the mixing zone (primary zones 3 in FIG. 1A) as is described in K. 0. Smith et al, *Development of a Natural Gas-Fired Ultra-Low NOx Can Combustor for an* 800 kw Gas Turbine, ASME 19-GT-303 (presented June 1991). In this technique, a large plunger ahead of the inlet tube to the combustor modulates the airflow to the combustor. Since the plunger controls airflow to the mixing zone (but not to the dilution zones), the plunger varies the total open area through the combustor which affects the pressure drop across the combustor. Thus, air staging denigrates gas turbine efficiency by increasing the pressure drop through the combustor. In addition, the plunger appears to have numerous operating positions to complicate its operation.

SUMMARY OF INVENTION

There has been a long-felt need for a device to control the air distribution in a gas turbine combustor that is both mechanically simple and maintains a nearly constant fuel/air ratio in the mixing zone of the combustor. In addition, there has been a long-felt need for a combustor air control device which does not vary the pressure loss through the combustor. The current invention satisfies these needs through the use of poppet valves in the combustor. These poppet valves direct air to either the mixing zone or dilution zone of the combustor as needed. In addition, the poppet valves do not change the total open area through the combustor and, thus, do not affect the total pressure loss in the combustor.

The advantages of the poppet valves include that they maintain a nearly constant fuel/air ratio in a gas turbine combustor. The valves are advantageously mechanically simple in that they each have only two operating positions. It is also an advantage that the mechanical operative components of the valves and the air distribution manifolds are entirely within the confines of the pressure vessel of the gas turbine. In addition, the poppet valves provide an advantageous constant open area through the combustor so that the pressure drop across the combustor remains substantially constant over the range of operation of the gas turbine.

In particular, the present invention, in a preferred embodiment, is a gas turbine having a compressor, a combustor receiving compressed air from said compressor, and a turbine receiving combustion gases from said combustor, wherein said combustor comprises:

a casing coupled to said gas turbine for receiving air from the compressor and for exhausting heated combustion gases to said turbine;

a combustor liner mounted within said casing and having zones for mixing fuel and air, combusting the fuel/air mixture and for dilution air, said liner having at least one mixing air entry holes upstream of said zone for mixing fuel and air and having a dilution air entry hole downstream of said zone for combusting the fuel-/air mixture;

an air distribution manifold receiving air from said casing through a poppet valve opening and directing air into said zone for dilution air in said liner; and a poppet valve operatively coupled to said casing and alternatively sealing said poppet valve opening in said air distribution manifold and said mixing air entry hole in said liner.

DETAILED DESCRIPTION OF THE DRAWINGS

Figure 1B:
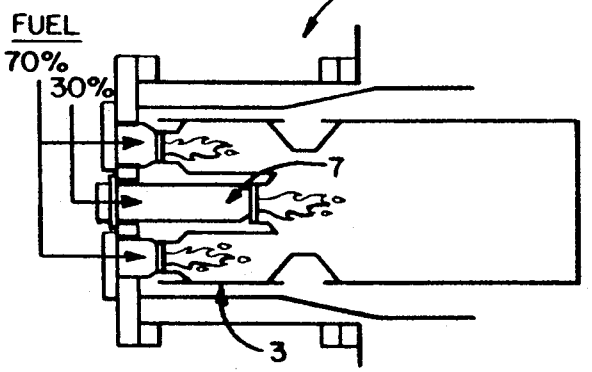
FIG. 1B PRIOR ART
FIGS. 1A through 1D show a prior art fuel staging combustor described above in the background art section.
Figure 1D:
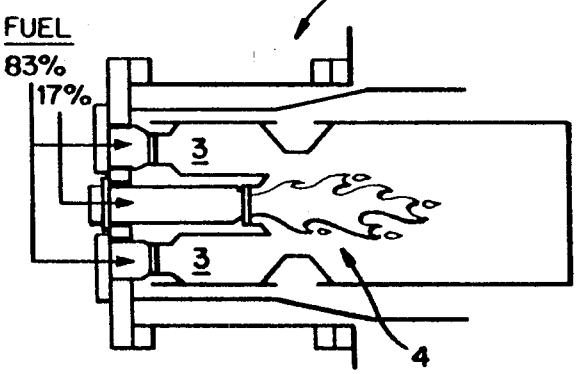
FIG. 1D PRIOR ART
Figure 1A:
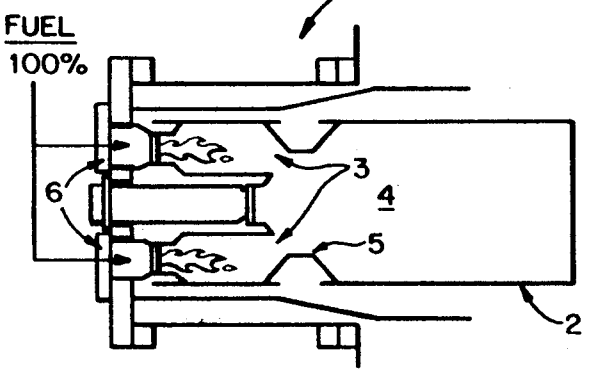
FIG. 1A PRIOR ART
Figure 1C:
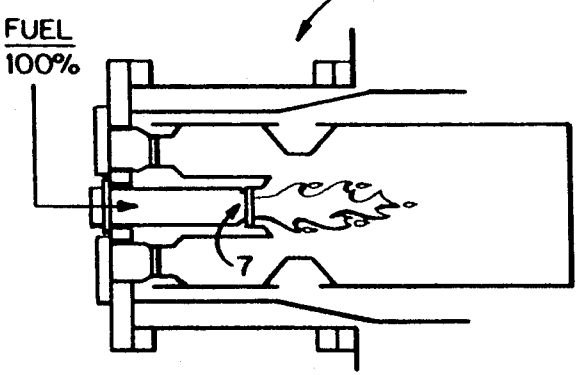
FIG. 1C PRIOR ART
Figure 2:
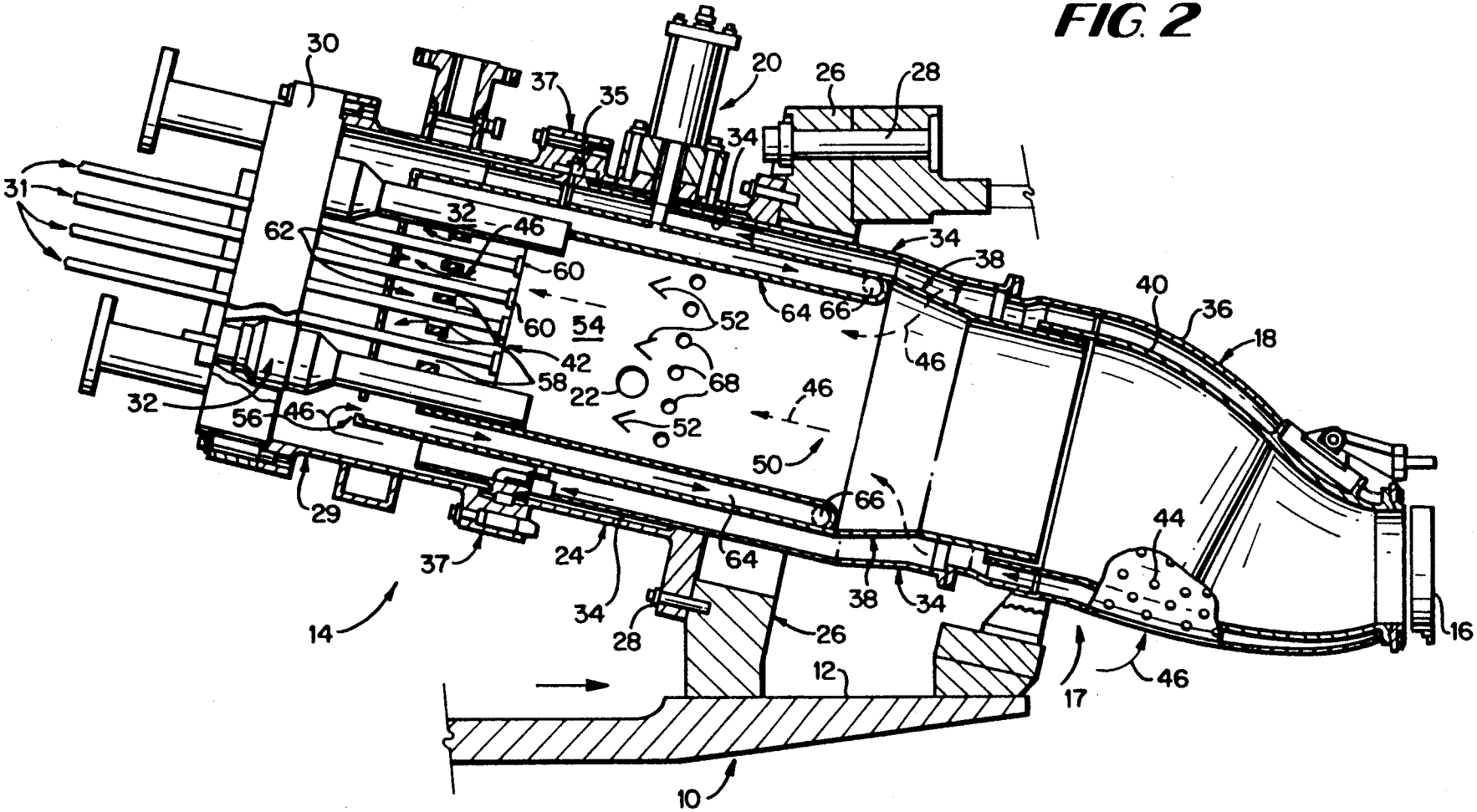
FIG. 2 is a partial cross section of a combustor section of a gas turbine in accordance with an exemplary embodiment of the combustor invention.

As shown in FIG. 2, a gas turbine 10 includes a compressor 12 (compressor housing partially shown), an annular array of combustors 14 (one shown), and a turbine represented here by a single turbine blade 16. Although not shown, the turbine drives a rotating compressor along one or more concentric shafts. Pressurized air from the compressor is ducted towards the front end 17 of the combustor. The air enters a double-walled annular transition duct 18 that directs the air in a reverse direction through the combustor to cool the combustor.

Each combustor 14 includes a spark plug 20 to ignite the fuel/air mixture in the combustor. Cross fire tubes 22 (only one shown) interconnect each of the combustors to allow a flame in one combustor to ignite another combustor.

Each combustor 14 includes a substantially cylindrical combustion casing 24 secured at an open front end to the turbine casing 26 by bolts 28. The rear end 29 of the casing is closed by end cover assembly 30 which may include sealed orifices for poppet valve stems 31 and for more conventional supply tubes. The end cover may also include conventional manifolds and valves for natural gas, liquid fuel and air and water associated with supply tubing to the combustor. In addition, the end cover receives a plurality of fuel nozzle assemblies 32 arranged in a circular pattern about the longitudinal axis of the combustor.

Inside the combustor casing 24 is a cylindrical flow sleeve 34 concentric to the casing and that connects at its forward end to the outer wall 36 of the double walled transition duct 18. The flow sleeve 34 is connected at its rear end to the combustor casing 24 via a radial flange 35 near the joint 37 between the fore and aft sections of the combustor casing.

A combustion liner 38 is concentrically mounted within the flow sleeve 34. The inner wall 40 of the front of the liner connects to the transition duct 18. The rear end of the liner is supported by the combustion liner cap assembly 42 which is secured to the combustor casing at butt joint 37. The outer wall 36 of the transition duct and a portion of the flow sleeve 34 extend forward of where the combustion casing bolts 28 to the turbine casing 26. This section of the outer wall inside the turbine casing is perforated 44 to allow compressed air to enter the combustor and flow in a reverse direction in the annular duct between the flow sleeve 34 and liner 36 toward the upstream (rear) end of the the combustor casing as is indicated by the flow arrows 46.

Figure 3:
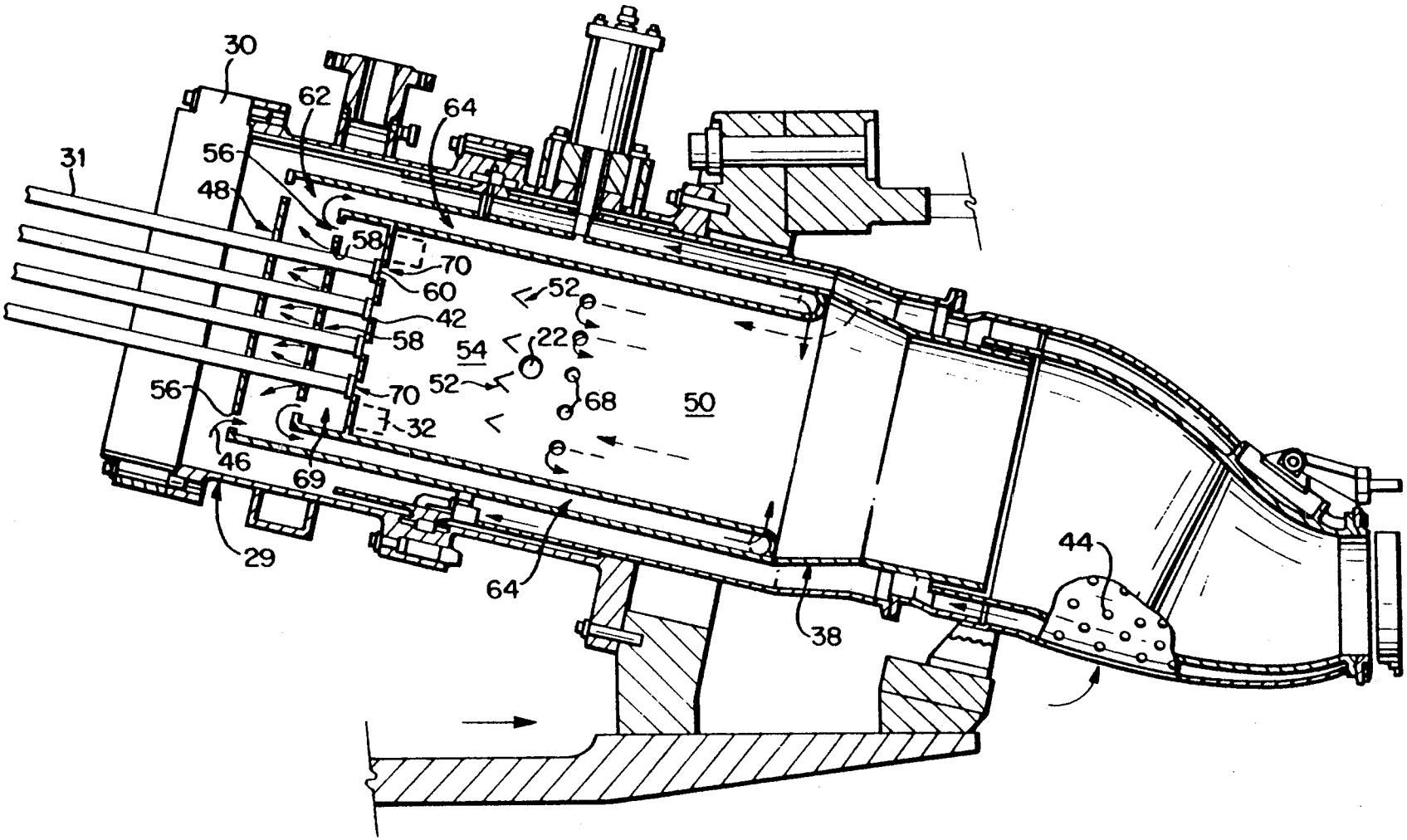
FIGS. 3 and 4 are additional diagrams of the exemplary embodiment of the combustor showing the operation of the poppet valves.

As best shown in FIG. 3, an air dilution manifold 48 directs air from the rear 29 of the combustor casing to a dilution zone 50 in the combustion liner downstream of the flame holding zone 52 and the fuel/air mixing zone 54. Air enters the air dilution manifold through air entry holes 56 that continuously remain open and through open poppet valve holes 58. Poppet valve stems 31 extend through the poppet valve holes 58 in the air dilution manifold.

The poppet valve holes are open when the poppet valve seals 60 are positioned against air openings in the liner cap 42 and are closed when the valve seals abut against the openings in the air dilution manifold. Upon entering the air dilution manifold, compressed air is received within a hollow cylindrical plenum chamber 62 between the liner cap and the end cover assembly 30 for the combustion casing. The plenum chamber distributes air to dilution air passage arms 64.

Dilution air passage arms 64 extend longitudinally along the outer periphery of the combustion liner from the air dilution plenum chamber to the dilution air entry holes 66 in the lining 38 downstream of the flame holder 52. The arms bridge a gap 69 between the air distribution manifold and the liner cap 42. This gap within the casing receives compressed air from the compressor. Air entering the gap flows either into the combustor mixing zone 54 or the dilution manifold 48 depending upon the setting of the poppet valves.

Additional dilution air also enters the combustion liner through dilution holes 68. Compressor air enters these dilution holes 68 without passing through the air dilution manifold. (For clarity, the flow arrows 46 are broken to show that air outside of the liner enters the liner.)

Each poppet valve seal 60 is operated such that it either seals its corresponding valve opening 58 in the air dilution manifold or its corresponding mixing air entry holes 70 in the liner cap 42. Each poppet valve has only two operating positions both of which leave one combustor liner air entry hole open and a corresponding hole closed. In this way, the operation of the poppet valves does not change the total open area through the overall combustor and does not vary the pressure loss through the combustor. By setting the poppet valves, the amount of air entering the mixing zone can be controlled so as to maintain a constant fuel/air ratio in the mixing zone of the liner.

In FIG. 3, all of the poppet valves 31 are retracted to seal the mixing air holes 70 to the mixing zone of the combustion liner. Thus, the volume of air entering the mixing zone is minimized because most of the air entry to the mixing zones are closed by the poppet valves. The amount of air in the mixing zone can be controlled through operation of the poppet valves because air enters the front of the combustor primarily through mixing holes 70 in the liner. When fuel flow is low, a constant fuel/air ratio can be maintained by retracting the poppet valves to close the mixing hole and thereby reduce the volume of air entering the mixing zone of the combustors.

The poppet valves do not control the entire airflow into the combustion lining. For example, some compressor air enters the lining downstream of the flame through dilution holes 68 which are not closed by the poppet valves. Similarly, some air can enter the mixing zone even when the poppet valves close off mixing holes 70. In addition, a few holes 56 in the dilution manifold are always open and are not subject to the control of the poppet valves. Thus, some compressor air always passes through the dilution manifold and enters the combustion lining downstream of the flame holding zone 52. However, the amount of air entering the liner through dilution holes 78 depends on the position of the poppet valves. Thus, the poppet valves can be used to control the volume of dilution air in the combustor.

Figure 4:
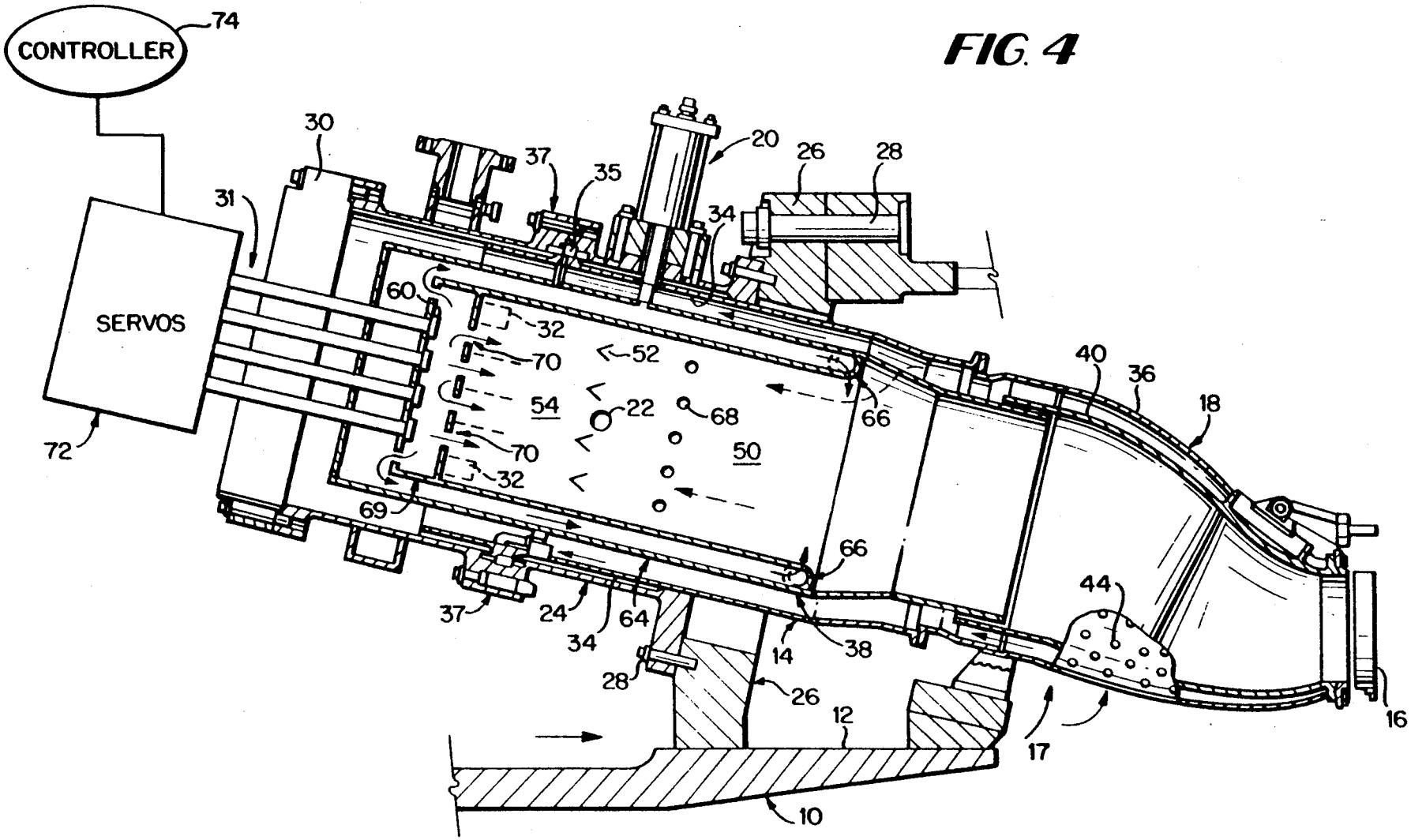

In FIG. 4 the poppet valve steams 31 have been advanced so that the valve seals 60 open the mixing holes 70 to the combustion liner and close the poppet holes in the air dilution manifold. Because of this arrangement of poppet valves, compressor air in gap 69 is directed through the mixing holes 70 into the mixing zone 54 of the liner. The volume of air passing through the liner cap and entering the mixing zone is increased. Thus, the poppet valves would be arranged as shown in FIG. 4 when the fuel flow is at or near maximum in order to increase the volume of air in the mixing zone to match proportionally the increased fuel flow and thereby maintain a constant fuel/air ratio.

The poppet valves are individually operated by servomotors 72 attached the stems of the valves 32 outside of the combustion casing. These servomotors are conventional and may be actuated mechanically, hydraulically, electromagnetically or in some other fashion. Moreover, the poppet valves for each combustion chamber may be actuated in unison or individually. It is envisioned that the poppet valves would ordinarily be individually actuated to maintain a constant fuel/air ratio in the mixing zone of each of the combustors.

The control system 74 for the poppet valves and servomechanisms is conventional and is part of the overall gas turbine control system. It is well known to operate gas turbine control system to meter fuel flow. It is within the level of ordinary skill in this art to fabricate a control system to operate the poppet valve servomechanisms where the control systems receives information regarding the fuel flow rate and the volume of air exiting the compressor and entering the combustors.

The invention has been described in connection with what is presently considered to be the most practical and preferred embodiment. However, the invention is not limited to the disclosed exemplary embodiment, but rather covers the various modifications and equivalent arrangements included within the spirit and scope of the appended claims.

What is claimed is:

1. A gas turbine having a compressor, a combustor receiving compressed air from said compressor, and a turbine receiving combustion gases from said combustor, wherein said combustor comprises;

a casing coupled to said gas turbine for receiving air from the compressor and for exhausting heated combustion gases to said turbine;

a combustor liner mounted within said casing and having zones for mixing fuel and air, combusting the fuel/air mixture and for dilution air, said liner having at least one mixing air entry hole upstream of said zone for mixing fuel and air, said air entry hole being substantially perpendicular to a flow of air into said zone for mixing fuel and air, and said combustor liner having a dilution air entry hole downstream of said zone for combusting the fuel/air mixture;

an air distribution manifold receiving air from said casing through a poppet valve opening and directing air into said zone for dilution air in said liner; and a poppet valve slidably mounted in said casing between said poppet valve opening in said air distribution manifold and said mixing air entry hole in said liner, said poppet valve moving linearly between said poppet valve opening and mixing air entry hole, and said poppet valve alternatively sealing said poppet valve opening and mixing air entry hole.

2. A gas turbine as in claim 1 wherein said poppet valve has a first operating position where one of said poppet valve opening is open and said mixing air entry hole is closed, and a second operating position where said poppet valve opening is closed and said mixing air entry hole is open.

3. A gas turbine as in claim 2 wherein said poppet valve opening and said mixing air entry hole both are sized so as to pass substantially the same volume of air such that the pressure drop across said combustor is substantially constant when said poppet valve is in its first and second operating positions.

4. A gas turbine as in claim 1 wherein said poppet valve comprises a valve seal for closing said poppet valve opening and, alternatively, said mixing air entry holes, and a valve stem extending from said valve seal out of said casing to a servomechanism that moves said poppet valve during operation of the gas turbine

5. A gas turbine as in claim 4 wherein said servomechanism is coupled to a gas turbine control means for operating said poppet valve to dynamically control the air distribution between said zones for mixing fuel and air and for dilution air.

6. A gas turbine as in claim 5 wherein said gas turbine control means maintains a substantially constant fuel-/air ratio in said zone for mixing fuel and air.

7. A gas turbine as in claim 1 further comprising a plurality of poppet valves wherein each poppet valve alternatively seals a poppet valve opening in said air distribution manifold and a corresponding mixing air entry hole upstream of said zone for mixing fuel and air in said liner.

* * * * *